US012715679B2

(12) United States Patent
Strecheniuk

(10) Patent No.: US 12,715,679 B2
(45) Date of Patent: Aug. 25, 2026

(54) CONTAINER, INTERMEDIATE PRODUCT, DENESTER AND A MANUFACTURING METHOD

(71) Applicant: Brødrene Hartmann A/S, Gentofte (DK)

(72) Inventor: Bruce Allan Strecheniuk, Waterloo (CA)

(73) Assignee: Brødrene Hartmann A/S, Gentofte (DK)

( * ) Notice: Subject to any disclaimer, the term of this patent is extended or adjusted under 35 U.S.C. 154(b) by 73 days.

(21) Appl. No.: 18/290,180

(22) PCT Filed: Jun. 8, 2022

(86) PCT No.: PCT/EP2022/065526
§ 371 (c)(1),
(2) Date: Nov. 10, 2023

(87) PCT Pub. No.: WO2022/258677
PCT Pub. Date: Dec. 15, 2022

(65) Prior Publication Data

US 2024/0253893 A1 Aug. 1, 2024

(30) Foreign Application Priority Data

Jun. 9, 2021 (EP) ..... 21178544

(51) Int. Cl.
*B65D 85/32* (2006.01)
*B65D 5/00* (2006.01)
*B65D 5/20* (2006.01)

(52) U.S. Cl.
CPC ..... *B65D 85/325* (2013.01); *B65D 5/001* (2013.01); *B65D 5/2047* (2013.01)

(58) Field of Classification Search
CPC .... B65D 85/325; B65D 5/001; B65D 5/2047; B65D 21/0233; B65D 5/243; B65D 85/32; B65D 81/3453
(Continued)

(56) References Cited

U.S. PATENT DOCUMENTS 9,718,576 B2 * 8/2017 Moore ..... B31B 50/81
11,434,038 B2 * 9/2022 Tye ..... B65D 5/20
(Continued)

FOREIGN PATENT DOCUMENTS

DE 19520331 A1 12/1996
EP 3786076 A1 3/2021
(Continued)

OTHER PUBLICATIONS

International Search Report for International Patent Application No. PCT/EP2022/065526 dated Sep. 28, 2022 (4 pages).
(Continued)

*Primary Examiner* — Christopher R Demeree
(74) *Attorney, Agent, or Firm* — Merchant & Gould P.C.

(57) ABSTRACT

The present invention relates to a container, an intermediate product for forming a container, a denester and method of manufacturing. The container and the inter-mediate product for forming the container comprise a first main part defining a top part or a bottom part of the container, and a number of side wall elements defining side surfaces of the top part or said bottom part. At least one of the side wall elements comprises a denester being made from material of the at least one side wall element, where the material is cut from the at least one wall element and bent into the interior of the container.

15 Claims, 4 Drawing Sheets

(58) Field of Classification Search
USPC ..... 229/100, 114, 117.12, 915, 113; 206/521.1, 521.6, 519
See application file for complete search history.

(56) References Cited

U.S. PATENT DOCUMENTS

| | | | | |
|---|---|---|---|---|
| 11,691,778 | B2 * | 7/2023 | Zwaga | B65D 5/243 229/113 |
| 12,246,890 | B2 * | 3/2025 | Nagel | B65D 5/28 |

FOREIGN PATENT DOCUMENTS

| | | | |
|---|---|---|---|
| GB | 1579535 | A | 11/1980 |
| WO | 2019092323 | A1 | 5/2019 |

OTHER PUBLICATIONS

Written Opinion of the International Searching Authority for International Patent Application No. PCT/EP2022/065526 dated Sep. 28, 2022 (5 pages).

* cited by examiner

CONTAINER, INTERMEDIATE PRODUCT, DENESTER AND A MANUFACTURING METHOD

CROSS-REFERENCE TO RELATED APPLICATIONS

This application is a National Stage Application of PCT/EP2022/065526, filed on 8 Jun. 2022, which claims the benefit of application Ser. No. 21178544.9, filed on 9 Jun. 2021 in Europe, and which applications are hereby incorporated by reference in their entireties. To the extent appropriate, a claim of priority is made to each of the above disclosed applications.

TECHNICAL FIELD

The invention relates to the field of manufacturing of packagings, such as containers for products or foods. Specifically, the invention relates a container, an intermediate product for forming a container, a denester, and a method for manufacturing the container and/or the intermediate product.

BACKGROUND OF THE INVENTION

When producing consumer packagings, such as e.g. containers for foods, including egg packages, different competing factors must be considered, such as appeal to the consumers, costs, sustainability, and efficiency in production.

Especially production costs can be minimized by providing a production and afterwards packaging process which is to a large extend automated with minimal production and packaging errors.

After production, the empty containers are stacked in large numbers for storage and for effective transportation to a packaging facility, such as an egg production facility, where the containers are filled and afterwards transported to the consumer marked.

By stacking, also referred to as nesting, the containers in large numbers, the needed storage space and transportation costs are minimized. Therefore, the containers are stacked as close to each other as possible to save volume space.

In order to fill the containers, each container has to be denested from the stack and conveyed to the subsequent processing equipment, such as a filling/packing equipment.

However, such closely nested containers tend to stick to each other, which causes problems in separation of the individual containers, which results in jamming of the processing equipment.

A jamming of processing equipment results in destroyed containers, lost products and possible a contamination of the processing equipment. Hereby the efficiency of an entire production line becomes compromised.

During the step of separation of the containers before being filled, the denesting equipment may damage the containers, which are usually relative fragile constructions.

Further, the containers may be, if not destroyed, then dented or bent such that e.g. an afterwards sealing of the containers with lids or film is difficult or even not possible because of a bent container structure.

Otherwise, the container may be cracked or otherwise damaged to the point of loss of structural stability. If such damage is not detected, the continued processing of the damaged container can result in loss of product, damage or contamination of the processing equipment.

The prior art has generally kept adjacent containers from nesting too closely together by the use of separating means, called "denesters", which can be arranged as an expanded shoulder or protrusion, which is commonly known within the technical field of containers manufactured from especially pulp, such as pulp-based egg packages.

The denesters are typically formed during the pulping process, hereby being molded during the same processing step as when the package is being formed.

As mentioned, the denesters are used for separating the stacked container and tend to compromise the stackability, such that the stack of containers becomes non-stable/wobbly. Further, the known types of denester for egg packages are typically connected to a rim part of the container, which requires a rim part, which is not present, especially when the container is manufactured from cardboard instead of molded pulp.

However, when manufacturing containers, such as egg packages, fruit trays, or packages for non-food products, where these containers are manufactured from a material like cardboard, where the container is e.g. formed from a substantially flat piece of material being folded into the finished product, i.e. the container, it is difficult to manufacture the denester in the same processing step as the container.

A container made from cardboard, is typically made by stamping a template from a piece of flat cardboard comprising cut-outs and e.g. folding lines, where the template is folded to the container.

It is an object of the present invention to provide a container, an intermediate product for forming a container, and a denester which eliminates the above-defined problems associated with the transportation and packing of the containers.

The above object and advantages, together with numerous other objects and advantages, which will be evident from the following description of the present invention, are according to a first aspect of the present invention obtained by:

A container for storing products such as foods, the container comprising a part defining a top part or a bottom part of the container, and a number of first side wall elements defining side surfaces of said top part or the bottom part, wherein at least one of the side wall elements comprises a denester being made from material of the at least one side wall element, the material being cut from the at least one side wall element and bent into the interior of the container, wherein the denester forms a hinge element extending from the side wall element, the hinge element having an axis of rotation being substantially perpendicular to a junction between the main surface and the wall element and extending from the region of the junction, such that said hinge element, when being bent into the interior of the container, extends away from the side wall element and along the main surface and has a plane being substantially perpendicular to the main surface.

Hereby is defined a container with improved stackability, which is easy to produce with standard processing equipment, requires no extra material for forming the denester, and can be manufactured with no additional product material.

As the denester is arranged as a hinge element extending from the region of the junction between the main surface and the side wall element and into the interior of the container, the denester extends proximate and along the mainsurface, such that when a second container is stacked on top of the "first" container, the denester is arranged between the bottom of the second container and the main surface of the first container. Hereby, when pressure from the second container or any further stacked containers is applied to the denester of the first container, the denester is in contact and hereby supported by the main surface of the first container, whereby the load from the stacked containers is transferred down through the stack, suct that the stack is stable.

The container may be part of a packaging unit, such as a top part and/or a bottom part of an egg package. The container may be a conventional cardboard container for packing foods or non-food items, where there exists a need for stacking the empty container from e.g. a packaging facility, such as an egg production facility or other packing facility where the empty containers are to be separated from the stacks and filled with products.

The container is preferable made from cardboard, which is a cheap and versatile material for forming containers, but may in an alternative embodiment be manufactured from a different material, such as moulded pulp or plastic. Containers from moulded pulp or plastic may comprise a main surface and side wall elements formed as a single unit.

According to a further embodiment of the first aspect of the invention, the material comprises two cuts defining two side edges of the denester, the hinge extending between the side edges.

The material comprises two cuts defining side edges of the denester and a non-cut part defining the hinge of the denester, which provides easy folding. The denester is arranged from a piece of material which is not completely cut out of the side wall elements, such that the non-cut part of the denester forms a hinge of the denester. The denesters may thus be made in different sizes according to need, e.g. in relation to the size of the container.

According to a further embodiment of the first aspect of the invention, one of the cuts is positioned substantially in the junction between the main surface and the wall element.

Positioning one of the cuts substantially in the junction, arranges the denester as close to the main surface as possible, which results in maximum support of the denester by the main surface.

According to a further embodiment of the first aspect of the invention, the side edges are longitudinal side edges of the denester, and the hinge forms a transverse edge of the denester.

Providing the cuts such that the side edges of the denester are longitudinal edges and the hinge is a shorter transverse edge of the denester has the effect that the denester extends a certain distance along the main surface and into the interior of the container and ensures sufficient support for a second stacked container. Further, as the containers are manufactured from less form-stable materials, such as cardboard of pulp, the dimensions of the individual containers may vary a little, whereby a longer denester ensures that the second container is being supported by the denester of the first container.

According to a further embodiment of the first aspect of the invention, the at least one side wall element comprises a side wall main part and a connection flap connecting the at least one side wall element to an adjacent side wall element, the connection flap comprising the denester.

The denester may also be arranged partly or entirely in the connection flap. When being arranged entirely in the connection flap, the opening created in the side wall element when the denester is bent towards the interior of the container is covered by the interconnected neighboring element, such that the arrangement of the denester is not visible from the outside of the container. This provides a container with enhanced visual appearance, but also provides a container with no openings in the side wall elements for increased sealing of the content of the container when being closed.

According to a further embodiment of the first aspect of the invention, the at least one side wall element comprises a junction between said connection flap and the side wall main part, the junction forming a corner of the container, and the denester extending across the junction.

In another embodiment, the denester may be arranged across the junction between the connection flap and the side wall main part of the side wall element, whereby the denester is arranged at a corner of the container. The denester is hereby cut from the material along two cuts extending across the junction, which preferably is arranged as a fold line. The denester hereby comprises two non-cut parts, one part being arranged on the connection flap, and the other part being arranged on the main part of the side wall element.

One of the cuts is preferably arranged substantial coaxially with the junction between the main surface and the side wall element having the denester, such that the denester, in the inside, is located with a minimum distance to the inside of the main surface hereby providing maximum support.

The other cut of the denester may be arranged as a straight cut if the desired angle between the main surface and the side wall element is intended to be approx. 90 degrees, or arranged as a V-shaped cut if the desired angle between the main surface and the side wall element is intended to be oblique.

According to a further embodiment of the first aspect of the invention, the container is an egg carton having a top part and a bottom part, where the denester is arranged in the top part and/or the bottom part.

The container having the denester may by any type of packaging, but is in a preferred embodiment an egg carton.

According to a second aspect of the present invention, the above objects and advantages are obtained by:

An Intermediate product comprising a piece of material for being further processed into a container for packing objects such as foods, the intermediate product comprising a first main part for defining a top part or a bottom part of the container, and a number of side wall elements for defining side surfaces of the top part or said bottom part, wherein the intermediate product further comprises a number of denester elements arranged as cutouts from the piece of material, and arranged to bend from the piece of material when processing the intermediate product into the container, where the denester forms a hinge element extending from the side wall element, the hinge element having an axis of rotation being substantially perpendicular to a junction between the main surface and the wall element and extending from the region of the junction, such that the denester, when being bent into the interior of said container, extends away from the side wall element and along the main surface and has a plane being substantially perpendicular to the main surface.

According to the second embodiment, the invention concerns an intermediate product comprising a piece of material, preferable a substantially flat piece of material, which can be transformed into a container as disclosed above. During production of the container, some first production steps include production of the substantially flat intermediate product with the needed main surface, side wall elements and in the desired dimension, such that each intermediate product can be folded into a container, and the denester bent inwards before stacking the empty containers.

As the denester is arranged as a hinge element extending from the region of the junction between the main surface and the side wall element and into the interior of the container, the denester extends proximate and along the main surface, such that when a second container is stacked on top of the "first" container, the denester is arranged between the bottom of the second container and the main surface of the first container. Hereby, when pressure from the second container or any further stacked containers is applied to the denester of the first container, the denester is in contact and hereby supported by the main surface of the first container, whereby the load from the stacked containers is transferred down through the stack, such that the stack is stable.

The container may be manufactured from molded pulp, plastic or even metal, such as aluminum, but is preferably manufactured from cardboard, which is a relatively cheap material and easy to work with in many different sizes.

According to a further embodiment of the second aspect of the invention, the material comprises two cuts defining two side edges of the denester, the hinge extending between the side edges.

The material comprises two cuts defining side edges of the denester and a non-cut part defining the hinge of the denester, which provides easy folding.

According to a further embodiment of the second aspect of the invention, one of the cuts is positioned substantially in the junction between the bottom part and said side wall element.

Positioning one of the cuts substantially in the junction, arranges the denester as close to the main surface as possible, which results in maximum support of the denester by the main surface.

The length of the hinge, and hereby the height of the hinge, may vary according to specific needs. In case of a large number of stacked empty containers, the height of the hinge, and hereby the height of the denester, is kept at a minimum, whereby the height of the stacked containers is kept at a minimum. In case of the containers having a dimension that makes separation difficult, the height of the hinge is relative larger, such that denesting is enhanced.

According to a further embodiment of the second aspect of the invention, the at least one side wall element comprises a side wall main part and a connection flap for connecting the at least one side wall element to an adjacent side wall element, the connection flap comprising the denester.

The denester may also be arranged partly or entirely in the connection flap. When being arranged entirely in the connection flap, the opening created in the side wall element when the denester is bent towards the interior of the container is covered by the interconnected neighboring element, such that the arrangement of the denester is not visible from the outside of the container. This provides a container with enhanced visual appearance, but also provides a container with no openings in the side wall elements for increased sealing of the content of the container when being closed.

According to a further embodiment of the second aspect of the invention, the at least one side wall element comprises a junction between the connection flap and the side wall main part, the junction arranged to form a corner of the container, and the denester extending across the junction.

As disclosed earlier, the denester may be arranged across the junction between the connection flap and the side wall main part of the side wall element.

According to a further embodiment of the second aspect of the invention, the container is an egg carton having a top part and a bottom part, where said denester is arranged in said top part and/or said bottom part.

According to a third aspect of the present invention, the above objects and advantages are obtained by:

A denester for a container and an intermediate product as described above, the denester being made from the material of the at least one wall element which is cut and bent.

According to a fourth aspect of the present invention, the above objects and advantages are obtained by:

A method for manufacturing an intermediate product and/or a container as described above, comprising the following steps:

providing a piece of cardboard, arranging an intermediate product by providing a main surface and a number of side wall elements, arranging at least one cut, hereby forming a denester element suitable to be bent out from the piece of material, and/or forming the container by bending the side wall elements in relation to said main surface, interconnecting at least two neighboring side wall elements, hereby forming a container, and bending the denester element into an interior of said container.

Figure 1A:
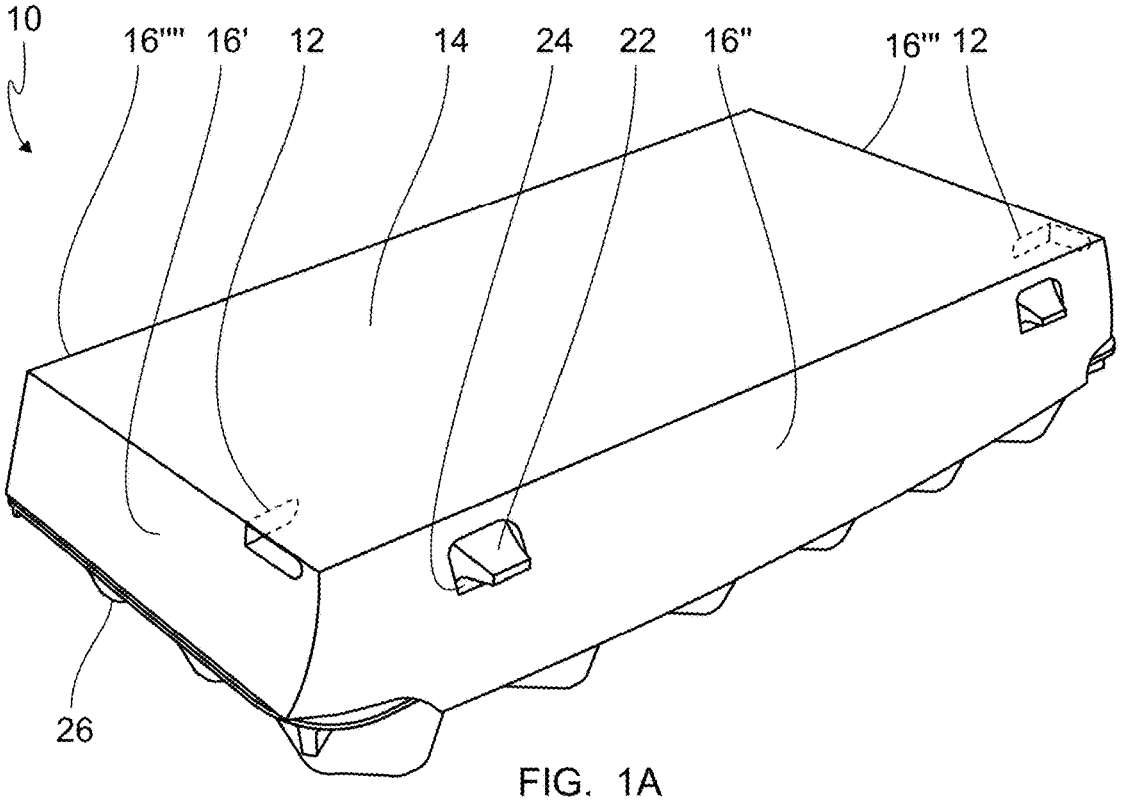
FIG. 1A is an upper perspective view of an egg package.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout. Like elements will thus not be described in detail with respect to the description of each figure.

FIG. 1A is an upper perspective view of an egg package. The figure shows a container 10, illustrated as an egg package comprising a top part, which comprises a main surface 14, a number of side wall elements 16'-16'''', and a bottom part 28. The top part is hingedly connected to the bottom part 28 at the rear side wall element 16''', the top part comprises openings 24, and the bottom part comprises lugs, for releasably interconnecting the two parts. Two of the side wall elements 16', 16''' comprise a denester 12, which is defined by a part of the side wall elements 16', 16''' which has been cut during a previous processing step, and bent inwards. The two denesters 12 are arranged on opposite side wall elements 16'-16''' and towards the front of the container 10, but the top part may in an alternative embodiment comprise a denester on all of the side wall elements 16'-16'''', and each side wall element 16'-16'''' may comprise one or more denesters arranged along the length of the side wall elements 16'-16''''.

The part of the container having the denesters is preferably manufactured from cardboard, but may be manufactured from a different material, such as moulded pulp or plastic.

Figure 1B:
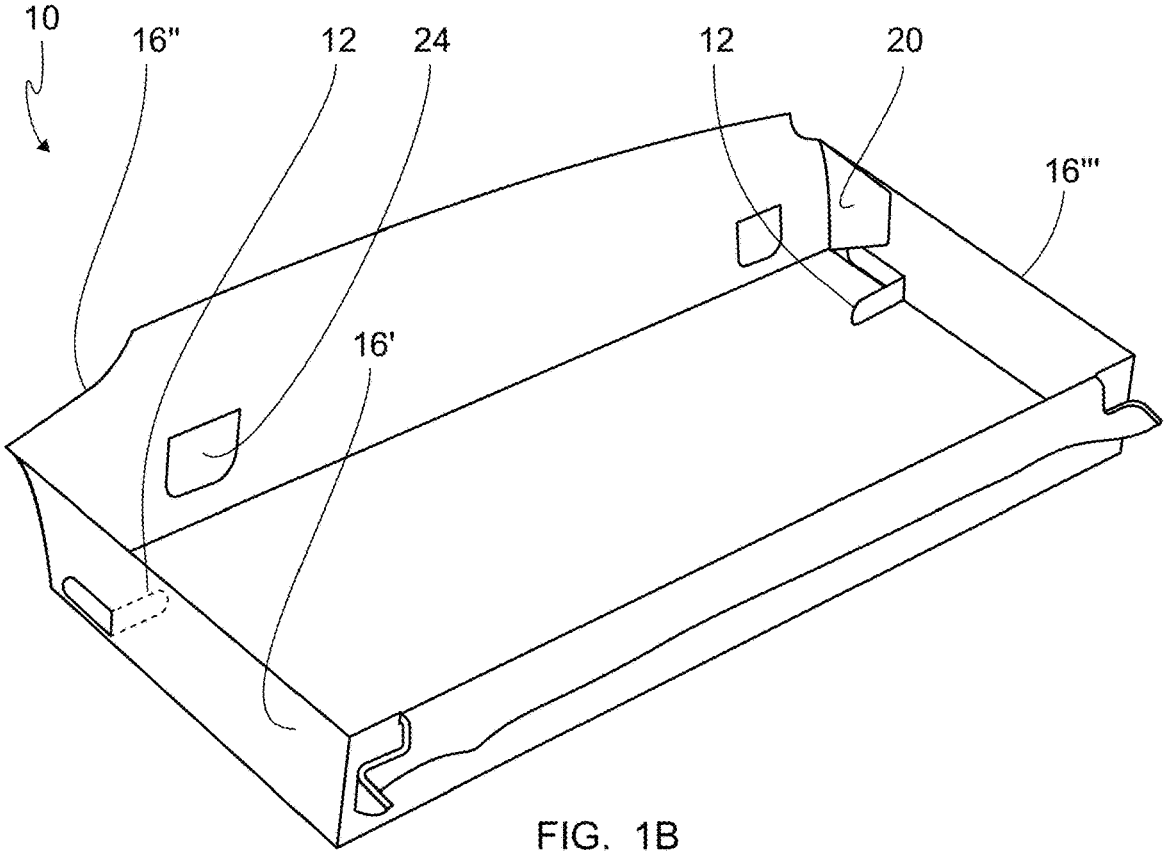
FIG. 1B is a lower perspective view of the upper part of an egg package.

FIG. 1B is a lower perspective view of the upper part of an egg package. FIG. 1B shows the same container 10 as illustrated in FIG. 1A, but the bottom part has been removed for illustrative purposes. The figure shows the two side wall elements 16'', 16''' being connected to each other via a connection flap 20 arranged in the side wall element 16" and attached to the neighbouring side wall element 16''' by e.g. a suitable glue. Only one connection flap is shown, i.e. the connection between the two side wall elements 16", 16''', but the side wall element 16" comprises a connection flap 20 for connection with the side wall element 16', and the side wall element 16'''' comprises two connection flaps at either end for connection with the side wall elements 16', 16'''. It is to be understood that the connection flaps 20 may be arranged differently, as long at the side wall elements are interconnected.

In an alternative embodiment, the container may be manufactured by a piece of moulded plastic, and the denesters are cut in one or more of the side walls of the container. In this alternative embodiment, no connection flaps are needed, but the flaps made of cut material from the side wall elements are bent inwards into the interior of the container as described earlier.

As can be seen, the denester 12 in the embodiment of FIG. 1B is arranged on the side wall element 16''' on a part not connected to the connection flap 20 for easy manufacturing.

The denesters 12 are, as shown in the figure, arranged in the region of the junction between the main surface 14 and the side wall elements 16',16''', in order for the main surface 14 to provide support for the denester 12. When a second container (or further numbers of containers) is being stacked on top of the first container 10, the denester is being supported by the main surface.

It is to be understood that the denester may be arranged in different sizes according to the desired need. Containers may thus comprise more or less than the two denester shown.

Figure 2:
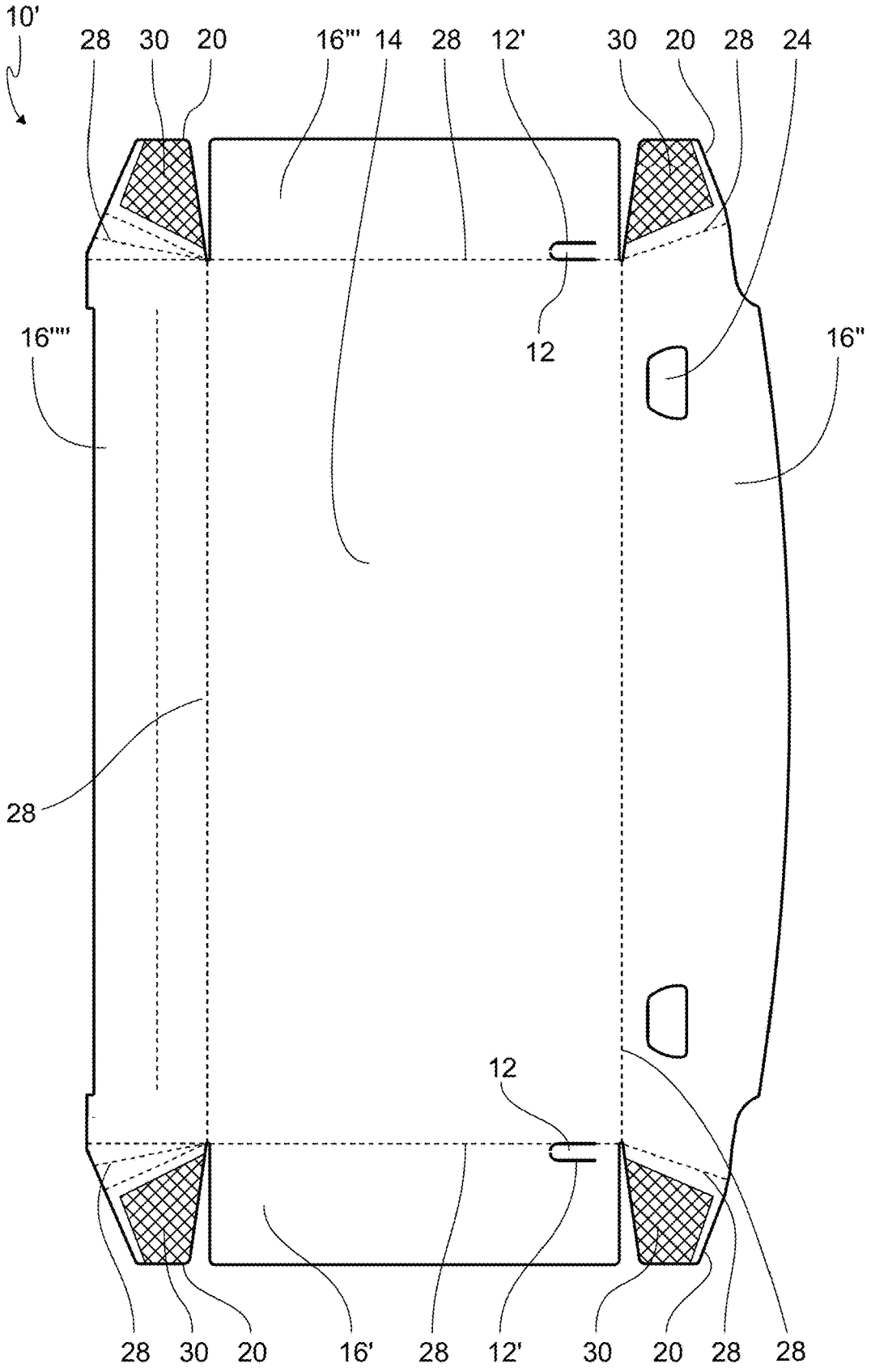
FIG. 2 is a top view of an intermediate product.

FIG. 2 is a top view of an intermediate product 10'. The figure shows the intermediate product 10' being arranged as a substantially flat piece, preferably a piece of cardboard, and suitable to be folded into the top part of the container 10 in FIGS. 1A and 1B. The intermediate product 10' comprises a main surface 14 and four side wall elements 16'-16'''' arranged to be folded and formed to a container 10. Two of the side wall elements 16", 16'''' comprise a side wall main part having a connection flap 20 at opposite ends for connection with the neighbouring side wall elements 16', 16''', and each connection flap 20 comprises a connection area 30 suitable for interconnection with the neighbouring side wall element 16', 16'''. The connection area 30 may be arranged with a suitable glue, double-sided tape, or any suitable means for interconnection.

The intermediate product 10' is shown with a number of fold lines 28 in order to allow the side wall elements 16'-16''' to be easily folded into the container. The folding lines may be weakenings arranged as score lines or embossings, etc. In a different embodiment, which is not shown, the intermediate product 10' is arranged without the fold lines 28. In this case, the manufacturing equipment performs the folding of the side wall elements 16'-16'''' without the need of fold lines 28.

Two of the side wall elements 16', 16''' comprise a cut 12', which is preferably arranged during the same processing step as the intermediate product 10' being stamped out of a larger piece of cardboard. The cuts 12' are shown arranged as substantially U-shaped cuts, such that the denesters 12 are not completely cut out of the side wall element material, but has a non-cut part, which acts as a hinge. The denesters 12 may be arranged differently than from a substantially U-shaped cut, such as a substantially square-shaped cut, etc., as long as the denester is not completely cut out of the side wall element material and can be folded into the interior of the container 10.

The denester may comprise a sectioned cut, such that the denester, besides the non-cut part which acts as a hinge, comprises another part of non-cut material, which serves to keep the denester 12 from being unintentionally folded out of the intermediate product 10' before the intended processing step. In FIG. 2, the second non-cut part of material is arranged on the opposite side of the denester 12 than the non-cut material serving as the hinge. The denester 12 may be arranged from a number of sectioned cuts 12' to provide the desired structural strength to the denester before the intended processing step of folding the container 10.

One of the cuts 12' is shown arranged in the junction between the main surface 14 and the side wall elements 16',16''', which arranges the denester adjacent and as close as possible to the main surface, such that the denester is supported by the main surface.

In an alternative embodiment (not shown), the denesters 12 are arranged only on the connection flap 20, whereby when the intermediate product 10' is folded into the container 10, part of the connection flaps 20 is on the outside covered by the interconnected neighbouring side wall element, whereby the denesters 12 are not visible from the outside of the container.

Figure 3A:
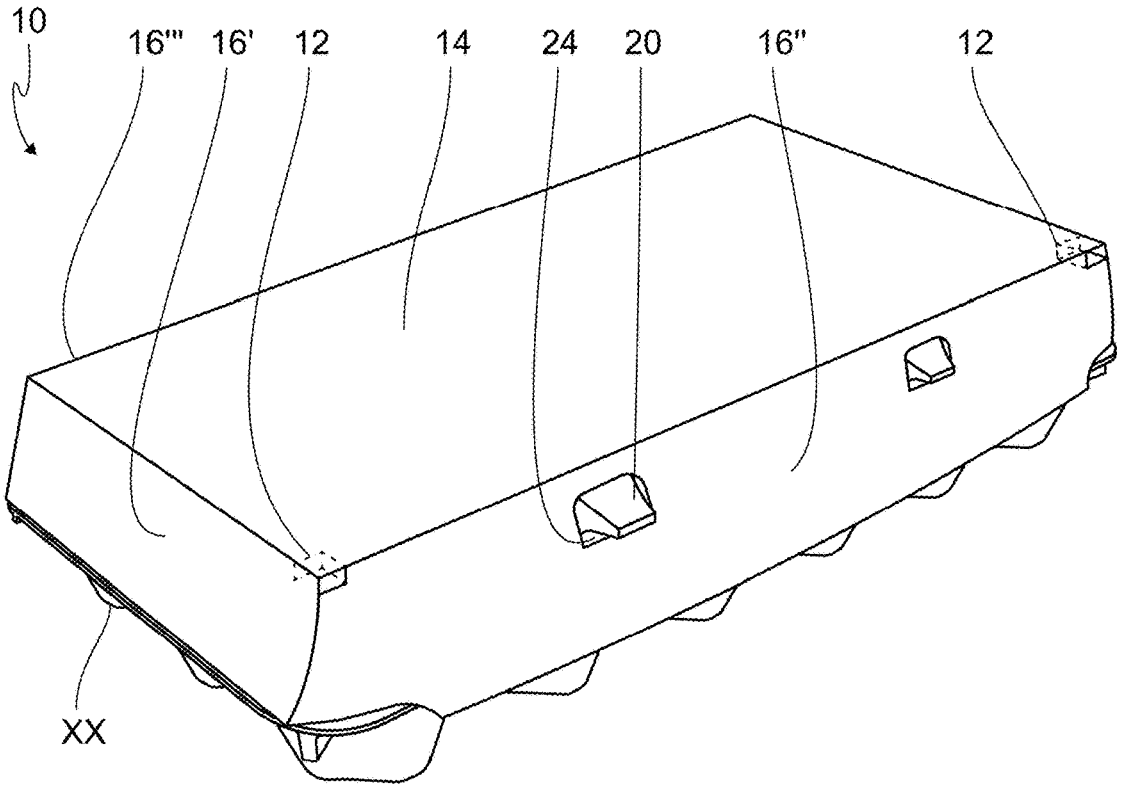
FIG. 3A is an upper perspective view of an egg package.

FIG. 3A is an upper perspective view of an egg package according to another embodiment of the denester 12. The construction of the container is, beside the construction of the denester 12, similar to the embodiment of FIGS. 1A and 1B.

It is further to be understood, that the denesters 12 disclosed in the different embodiments may be used in other containers than egg packages, such as containers for fruits, vegetables, or non-food products, where a stacking and easy separation of the containers before packing are needed.

The denester 12 shown in FIG. 3A is, compared to the denester in FIGS. 1A and 1B, arranged at a corner part of the container, i.e. at the junction of two neighbouring side wall elements in the finished folded state.

FIG. 3A shows two denesters arranged at two corner parts of the container 10, but may comprise a denester at any one of the corners, or all of them.

Figure 3B:
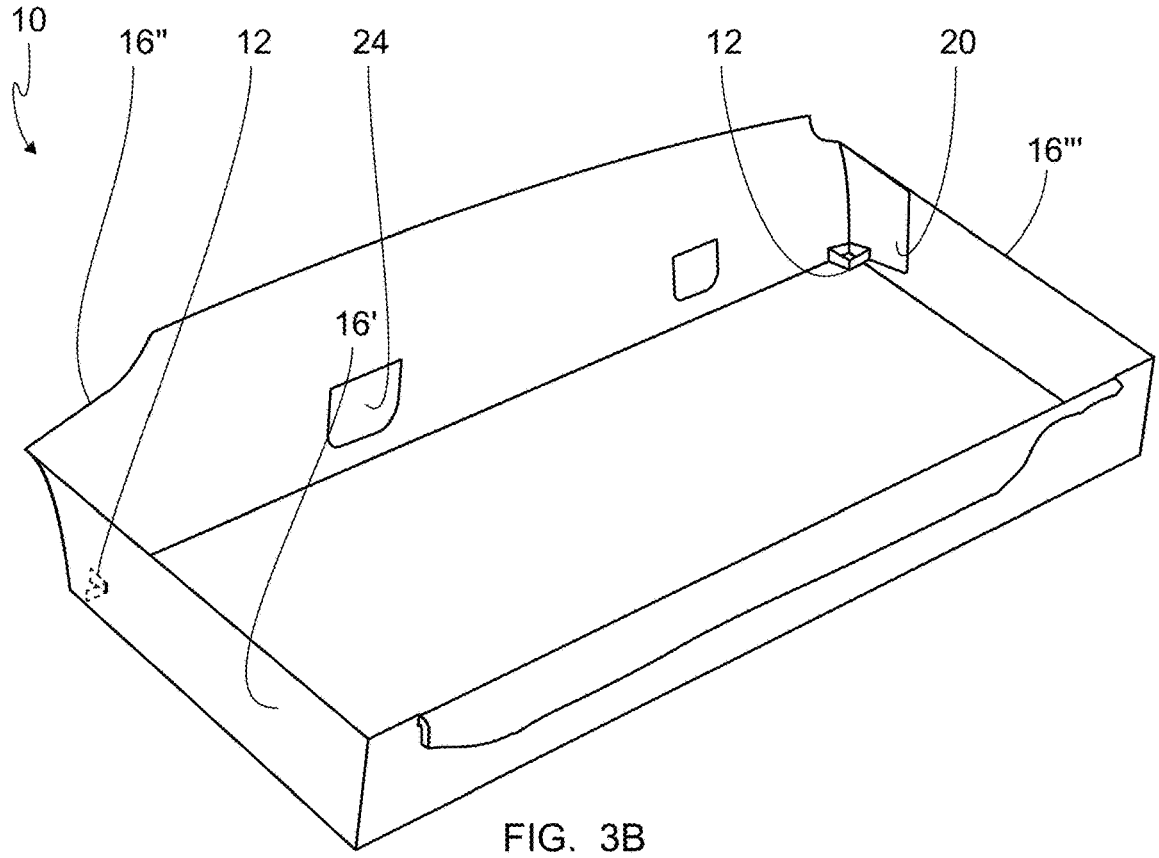
FIG. 3B is a lower perspective view of the upper part of an egg package.

FIG. 3B is a lower perspective view of the upper part of an egg package. FIG. 3B shows the denester 12 being arranged from the material of the side wall element 16", more specifically from the material of the main part of the side wall element 16" and the material from the connection flap 20. The denester 12 is in this embodiment arranged as a corner denester 12 made from cut material which at opposite ends is connected to the container side wall elements at both sides of the corner junction. As the side wall elements 16', 16''' not comprising the denester cuts are folded over the connection flaps 20, each denester is only visible from one side.

Figure 4:
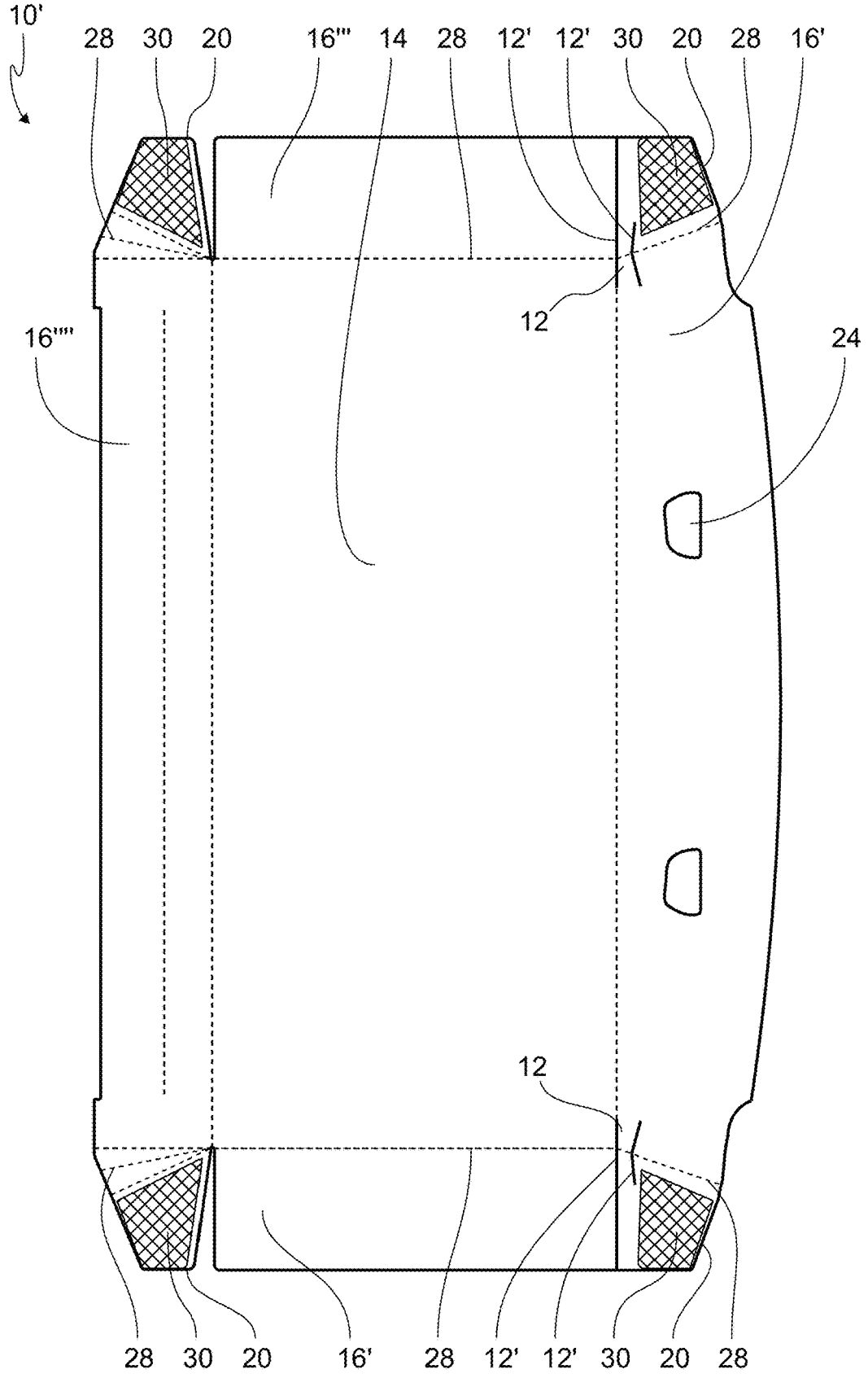
FIG. 4 is a top view of an intermediate product.

FIG. 4 is a top view of an intermediate product 10'. The figure shows the intermediate product 10' being arranged as a substantially flat piece, preferably a piece of cardboard, and suitable to be folded into the top part of the container 10 in FIGS. 3A and 3B.

The substantially flat piece of material is similar to the one shown in FIG. 2, but comprises the denesters 12 illustrated in FIGS. 3A and 3B.

Each denester 12 shown is arranged from two cuts 12', one cut 12' extending substantially coaxially with the junction between the main surface 14 and the side wall element 16', and the other cut 12' being arranged as a V-shaped cut 12' extending on the side wall main part and the connection flap across the fold line 28 between the side wall main part and the connection flap.

The shape of the V-shaped cut is arranged in relation to the intended angle between the main surface 14 and the side wall element 16', where in the shown embodiment the angle is intended to be oblique. In an embodiment where the angle is intended to be approximal 90 degrees, the V-shaped cut is instead substantially straight.

LIST OF REFERENCE NUMBERS

10 Container
10' Intermediate product
12 Denester
12' Cut
14 Main surface
16-16"" Side wall elements
20 Connection flap
22 Locking element
24 Opening
28 Fold line
30 Connection area

The invention claimed is:

1. Container for storing products such as foods, said container comprising a part defining a top part or a bottom part of said container and having a main surface, and a number of first side wall elements defining side surfaces of said top part or said bottom part, wherein at least one of said side wall elements comprises a denester being made from material of said at least one side wall element, said material being cut from said at least one side wall element and bent into an interior of said container, wherein said denester forms a hinge element extending from said at least one side wall element, said hinge element having an axis of rotation being substantially perpendicular to a junction between said main surface and said at least one side wall element and extending from a region of said junction, such that said hinge element, when bent into said interior of said container, extends away from said at least one side wall element and along said main surface and has a plane being substantially perpendicular to said main surface.

2. The container according to claim 1, wherein said material comprises two cuts defining two side edges of said denester, said hinge extending between said side edges.

3. The container according to claim 2, wherein one of said cuts is positioned substantially in said junction between said main surface and said wall element.

4. The container according to claim 2, wherein said side edges are longitudinal side edges of said denester and said hinge forms a transverse edge of said denester.

5. The container according to claim 1, wherein said at least one side wall element comprises a side wall main part and a connection flap connecting said at least one side wall element to an adjacent side wall element, said connection flap comprising said denester.

6. The container according to claim 5, wherein said at least one side wall element comprises a junction between said connection flap and said side wall main part, said junction forming a corner of said container, and said denester extending across said junction.

7. The container according to claim 1, wherein said container is an egg carton having a top part and a bottom part, where said denester is arranged in said top part and/or said bottom part.

8. A denester for a container and an intermediate product according to claim 1, said denester being made from the material of said at least one side wall element, which is cut and bent.

9. The denester according to claim 8, said denester, before being folded, being made from at least two separate cuts.

10. An intermediate product comprising a piece of material for being further processed into a container for packing objects such as foods, said intermediate product comprising a part for defining a top part or a bottom part of said container and having a main surface, and a number of side wall elements for defining side surfaces of said top part or said bottom part, wherein said intermediate product further comprises a number of denester elements arranged as cutouts from said piece of material, and arranged to bend from said piece of material when processing said intermediate product into said container, wherein said denester elements form hinge elements extending from said side wall elements, said hinge elements having an axis of rotation being substantially perpendicular to a junction between said main surface and said side wall elements and extending from a region of said junction, such that said denester elements, when bent into an interior of said container, extend away from said side wall elements and along said main surface and have a plane being substantially perpendicular to said main surface.

11. The intermediate product according to claim 10, wherein said material comprises two cuts defining two side edges of a connection flap, said hinge extending between said two side edges.

12. The intermediate product according to claim 11, wherein one of said cuts is positioned substantially in said junction between said bottom part and one of said side wall elements.

13. The intermediate product according to claim 10, wherein said at least one of said side wall elements comprises a side wall main part and a connection flap for connecting said at least one of said side wall elements to an adjacent side wall element, said connection flap comprising at least one of said denester elements.

14. The intermediate product according to claim 13, wherein said at least one of said side wall elements comprises a junction between said connection flap and said side wall main part, said junction being arranged to form a corner of said container, and at least on of said denester elements extending across said junction.

15. The intermediate product according to claims 10, wherein said container is an egg carton having a top part and a bottom part, where at least on of said denester elements is arranged in said top part and/or said bottom part.

* * * * *